US008794961B2

(12) United States Patent
Chandler et al.

(10) Patent No.: US 8,794,961 B2
(45) Date of Patent: Aug. 5, 2014

(54) COOLING ARRANGEMENT FOR A COMBUSTION CHAMBER

(75) Inventors: Paul I. Chandler, Birmingham (GB); Anthony Pidcock, Derby (GB)

(73) Assignee: Rolls-Royce, PLC, London (GB)

( * ) Notice: Subject to any disclaimer, the term of this patent is extended or adjusted under 35 U.S.C. 154(b) by 1077 days.

(21) Appl. No.: 12/822,445

(22) Filed: Jun. 24, 2010

(65) Prior Publication Data

US 2011/0016874 A1 Jan. 27, 2011

(30) Foreign Application Priority Data

Jul. 22, 2009 (GB) ..... 0912715.0

(51) Int. Cl.
*F23R 3/04* (2006.01)
*F23R 3/00* (2006.01)

(52) U.S. Cl.
CPC ..... *F23R 3/002* (2013.01); *F23R 2900/03044* (2013.01); *F23R 3/04* (2013.01); *F23R 2900/03041* (2013.01)
USPC ..... 431/352; 60/754

(58) Field of Classification Search
USPC ..... 431/350, 351, 352, 23, 195, 201, 202; 60/752, 753, 754, 772, 755, 756
See application file for complete search history.

(56) References Cited

U.S. PATENT DOCUMENTS

| | | | | |
|---|---|---|---|---|
| 5,224,542 | A * | 7/1993 | Hemsath | 431/352 |
| 5,758,504 | A | 6/1998 | Abreu et al. | |
| 6,170,266 | B1 * | 1/2001 | Pidcock et al. | 60/755 |
| 6,546,731 | B2 * | 4/2003 | Alkabie et al. | 60/754 |
| 6,964,170 | B2 * | 11/2005 | Alkabie | 60/772 |
| 2001/0004835 | A1 | 6/2001 | Alkabie et al. | |
| 2010/0037620 | A1 * | 2/2010 | Chila | 60/752 |

OTHER PUBLICATIONS

Search Report in British Patent Application No. 0912715.0, dated Nov. 10, 2009.

* cited by examiner

*Primary Examiner* — Kenneth Rinehart
*Assistant Examiner* — Tavia Sullens
(74) *Attorney, Agent, or Firm* — Oliff PLC

(57) ABSTRACT

A cooling arrangement for a surface of a wall in a gas turbine engine, the wall having a plurality of effusion holes each with an outlet onto the surface for supplying an effusion flow to the surface and an inlet, the inlets of the effusion holes being arranged at the peripheries of groups tessellated on an opposing surface of the wall, each inlet being located on the peripheries of three groups. The arrangement comprises a second wall spaced apart from the opposing surface having impingement orifices each for directing a flow of air in use to a respective impingement location on the opposing surface, each group having a centrally positioned impingement location.

11 Claims, 4 Drawing Sheets

COOLING ARRANGEMENT FOR A COMBUSTION CHAMBER

This invention relates to cooling arrangements for hot surfaces and primarily, though not exclusively, to cooling arrangements for combustion chambers found within gas turbine engines.

A hot surface in this application is not defined by its temperature but rather by its orientation to a high temperature region or combustion region. A hot surface for a particular component is a surface which faces the high temperature region. It can be contrasted with a cold surface which is a surface of the component that does not face the high temperature region. It is to be appreciated that the terminology means a hot surface is a hot surface even at ambient or low temperatures.

Combustion chambers in gas turbines define a volume within which fuel is burnt at very high temperatures that are often greater than the natural melting point of the material providing the combustor walls. The walls can be made of materials with very high melting points but these materials tend to be very expensive and/or fragile. In order to cut down on material cost and provide a robust combustor it is typical for the walls to be cooled by some of the air flowing through the engine and which has not been heated by the burning fuel. For very high temperature applications it is known to functionally divide the wall into a structural casing that supports a spaced apart inner wall that can be provided by a number of tiles which face the combustion volume and which are made of, or have coatings of, a thermally resistant material.

In a two wall arrangement the inner wall can be cooled by impingement jets of air that flow through apertures provided in the structural casing. The jets pass across the space that is defined between the casing and the inner wall and impinge on the radially outer surface of the inner wall i.e. the surface of the inner wall that does not face the combustion volume, which is also known as the cold surface of the inner wall despite being at many hundreds of degrees Celsius when the combustor is in operation. The air in the space is admitted to the combustion volume through a series of effusion holes provided in the inner wall that feed the air through the inner wall to form a film of air on the radially inner surface, or hot surface, of the inner wall. The film of air protects the wall of the combustor from the hot combustion gasses.

In a known arrangement, described in U.S. Pat. No. 6,546,731 and reproduced as FIG. 1, the effusion holes 2 can be arranged in hexagonal groups with the effusion holes located at the corners of each hexagon 4. The direction of flow of the hot combustion gas within the combustion volume is indicated by arrows 8. The impingement apertures on the outer casing are aligned to present the impingement air such that it impacts on the inner wall within the border of the hexagons 4 at an impingement location 10.

As can be seen in FIG. 1 the impingement air impacts the inner wall slightly away from the centre of the hexagon 4. This is to permit a seventh and central effusion hole 12 to be located within the boundary of each hexagon. The seventh hole ensures that there is a uniform spacing in a direction perpendicular to the general flow 8 of hot gas through the combustor.

Locating the position the impingement air impacts on the inner wall away from the centre of each hexagon means that cooling air from each of the impingement holes is fed to the effusion holes in an uneven distribution with the three closest holes shown by triangle 14 receiving the majority of the airflow to provide uneven effusion flow onto the hot face of the inner wall.

As the casing and inner walls are subject to different temperatures there is a differential in the thermal expansion between the two components. Using a central effusion hole reduces spacing between the effusion hole and the impingement location point 10 such that in some conditions it is possible for the impingement location point 10 to overlie the central effusion hole 12. In these cases a significant proportion of the impingement cooling air flows straight through the central effusion hole to further increase the uneven distribution of air flowing through the effusion holes and protecting the hot surface of the inner wall of the combustor.

It is an object of the present invention to seek to provide an improved cooling arrangement for a hot surface.

According to a first aspect of the invention there is provided a cooling arrangement for a surface of a wall, the wall having a plurality of effusion holes each with an outlet onto the surface for supplying an effusion flow to the surface and an inlet, the inlets of the effusion holes being arranged at the peripheries of groups tessellated on an opposing surface of the wall, each inlet being located on the peripheries of three groups, the arrangement comprises a second wall spaced apart from the opposing surface having impingement orifices each for directing a flow of air in use to a respective impingement location on the opposing surface, each group having a centrally positioned impingement location.

Alternatively, there may be provided a cooling arrangement for a surface of a wall, the wall having a plurality of effusion holes each with an outlet onto the surface for supplying an effusion flow to the surface and an inlet, the inlets of the effusion holes being arranged at the peripheries of groups tessellated on an opposing surface of the wall, each inlet being located on the peripheries of three groups, wherein the inlets of the effusion holes and their respective outlets are laterally offset in the plane of the surface and are connected by a bore, the bores being directed to avoid the centre of the group.

Preferably the inlets of the effusion holes and their respective outlets are laterally offset in the plane of the surface.

Preferably the peripheries of the groups tessellated on the opposing surface define regular or irregular hexagons.

The inlets of the effusion holes and their respective outlets may be connected by a bore, the bores being directed to avoid the centre of the group. Preferably the bores are straight and the inlets have an oval shape, wherein the longer axis of the ovals are rotated in the plane of the surface away from an axis of symmetry.

According to a second aspect of the invention there is provided a cooling arrangement for a surface of a wall, the wall having a plurality of effusion holes arranged in groups tessellated on the surface, the outlet of each effusion hole being located on a periphery of three groups;

Wherein each group has the shape of an irregular hexagon having two axis of reflective symmetry and four sides of equal length and two sides of a shorter length.

Each effusion hole may have an inlet that is connected to its respective outlet by a bore, with the inlets being laterally offset from its respective outlet in the plane of the surface.

Preferably the bores are straight and the inlets have an oval shape, wherein the longer axis of the ovals are rotated in the plane of the surface away from an axis of symmetry.

According to a third aspect of the invention there is provided a cooling arrangement for a surface of a wall, the wall having a plurality of effusion holes each with an outlet onto the surface for supplying an effusion flow to the surface and an inlet, the inlets of the effusion holes being arranged at the peripheries of groups tessellated on an opposing surface of the wall, each inlet being located on the peripheries of three groups, wherein the inlets of the effusion holes and their respective outlets are laterally offset in the plane of the surface and are connected by a bore, the bores being directed to avoid the centre of the group.

Preferably the bores are straight and the inlets have an oval shape, wherein the longer axis of the ovals are rotated in the plane of the surface away from an axis of symmetry.

According to a further aspect of the invention there is provided a method of cooling a surface of a wall, the wall having a plurality of effusion holes each with an outlet onto the surface for supplying an effusion flow to the surface and an inlet, the inlets of the effusion holes being arranged at the peripheries of groups tessellated on an opposing surface of the wall, each inlet being located on the peripheries of three groups, the wall being arranged with a second wall spaced apart from the opposing surface having impingement orifices each for directing a flow of air in use to a respective impingement location on the opposing surface, the method comprising the steps of directing a flow of air through the impingement orifices to the impingement location and subsequently feeding the air through the effusion holes to form an effusion film on the surface of the wall having the outlets.

Embodiments of the invention will now be described by way of example only, with reference to the accompanying drawings, in which.

Figure 1:
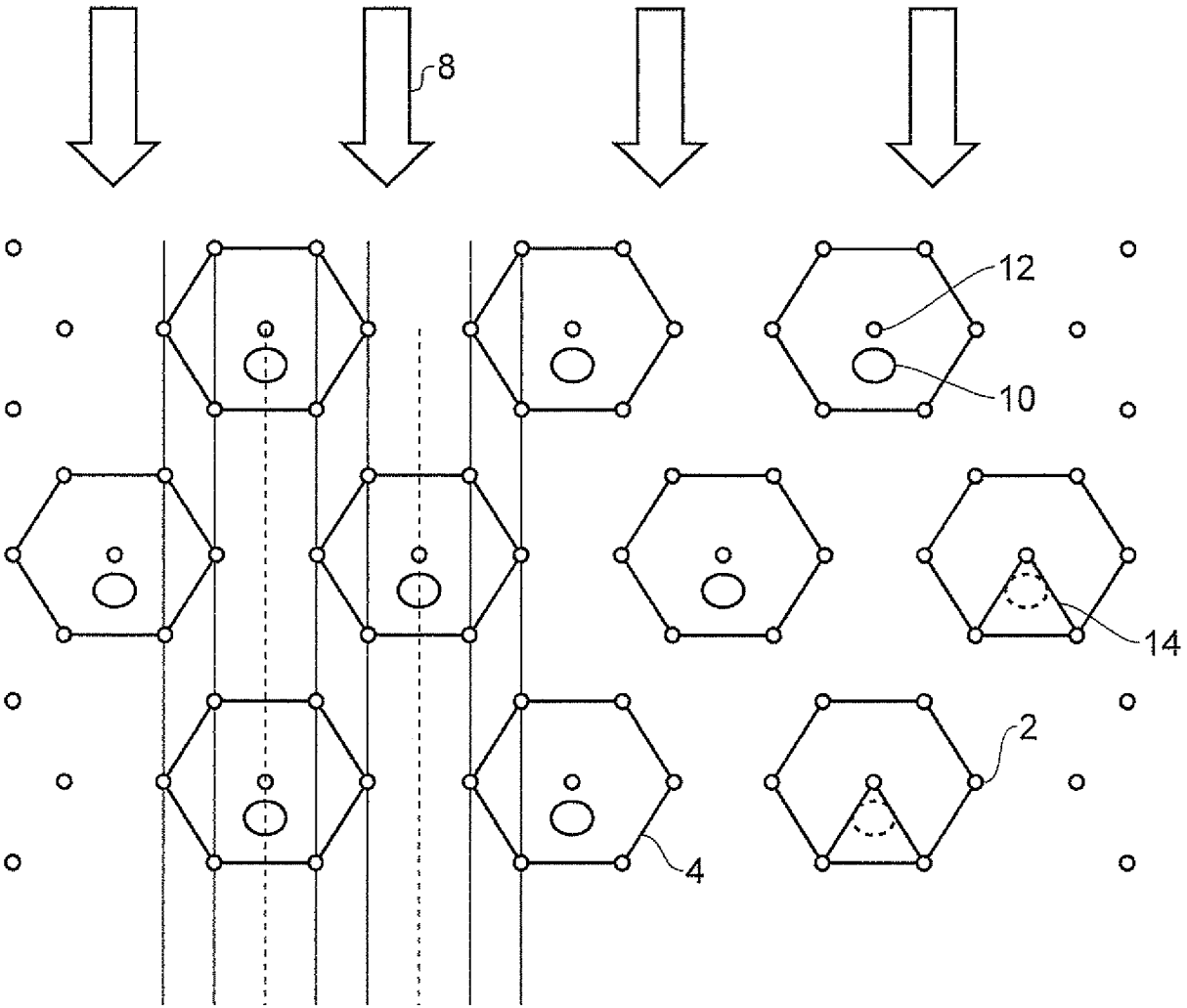
FIG. 1 (Prior Art)
FIG. 1 Depicts a prior art combustor cooling arrangement.
Figure 2:
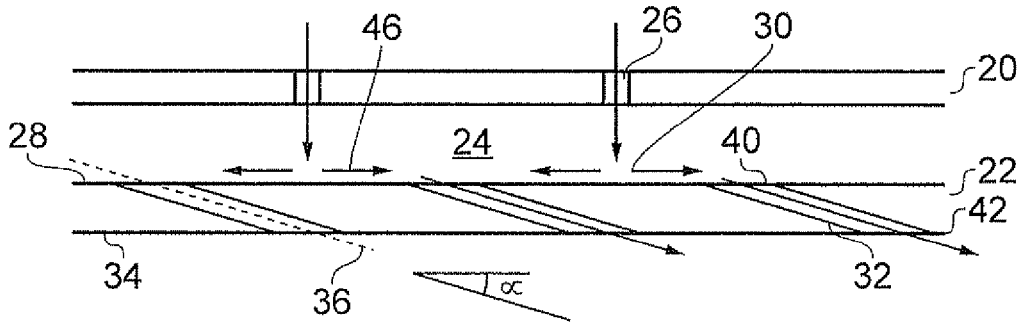
FIG. 2 Shows a cooling arrangement for a combustion chamber through a combustor wall FIG. 3 Shows a plan view of the wall of FIG. 2

FIG. 2 shows a two wall construction for an annular combustion chamber suitable for application in a turbine engine. An annular combustion volume is defined between coaxially arranged cylinders that share the main engine axis. The wall construction shown provides the outer boundary for the combustion volume and there is a similar wall construction (not shown) that provides an inner boundary for the combustion volume. The terms inner and outer are defined with respect to the main engine axis—the inner boundary is the boundary of the annular combustor which is closest to the engine axis. Fuel is injected into the combustion volume by injectors (not shown) and is burnt within a flow of combustion air that flows from an inlet at the upstream end of the combustion volume, the air being provided by the compressor section of the gas turbine, in a downstream direction to an outlet at the downstream end. The flow is generally axial i.e. it flows parallel to the engine axis but it can have a radial component or swirl.

Both the inner and outer boundaries of the combustor are formed by a two-wall arrangement that comprises an outer casing 20 and an inner wall 22. The inner wall defines the combustion volume. The inner wall and outer casing are coaxial with the engine centreline with the outer casing being at a greater radius than the inner wall 22 for the outer boundary and at a smaller radius than the inner wall for the inner boundary. The inner wall 22 is spaced apart from the outer casing 20 to provide a cavity 24. Air is fed through apertures 26 in the outer casing 20 by a pressure drop that creates an impingement jet that impinges onto the cold surface 28 of the inner wall 22 at an impingement location 30. The air forming the impingement jet radiates and spreads from the impingement location through the cavity 24 and is exhausted through effusion apertures 32. Each of the apertures lies at a shallow angle $\alpha$ that is between 10 and 35 degrees to the plane of the inner wall and this facilitates formation of an effusion film of air on the hot surface 34 of the inner wall.

The effusion holes 32 are formed by laser drilling and the axis 36 is aligned with the general flow direction of the hot combustion gas through the combustor to assist in the formation of a film of cool air over the hot surface of the inner wall. The film protects the hot surface from the hot combustion gas to increase the life of the wall. For the majority of the combustor the general flow is axial or substantially axial. In the front of the combustor, however, the hot gas can swirl with a tangential direction of up to 30° of more to the axial direction. Where the gas has swirl it can be beneficial to angle the effusion holes to the swirl to provide a swirl component to the effusion cooling.

Figure 3:
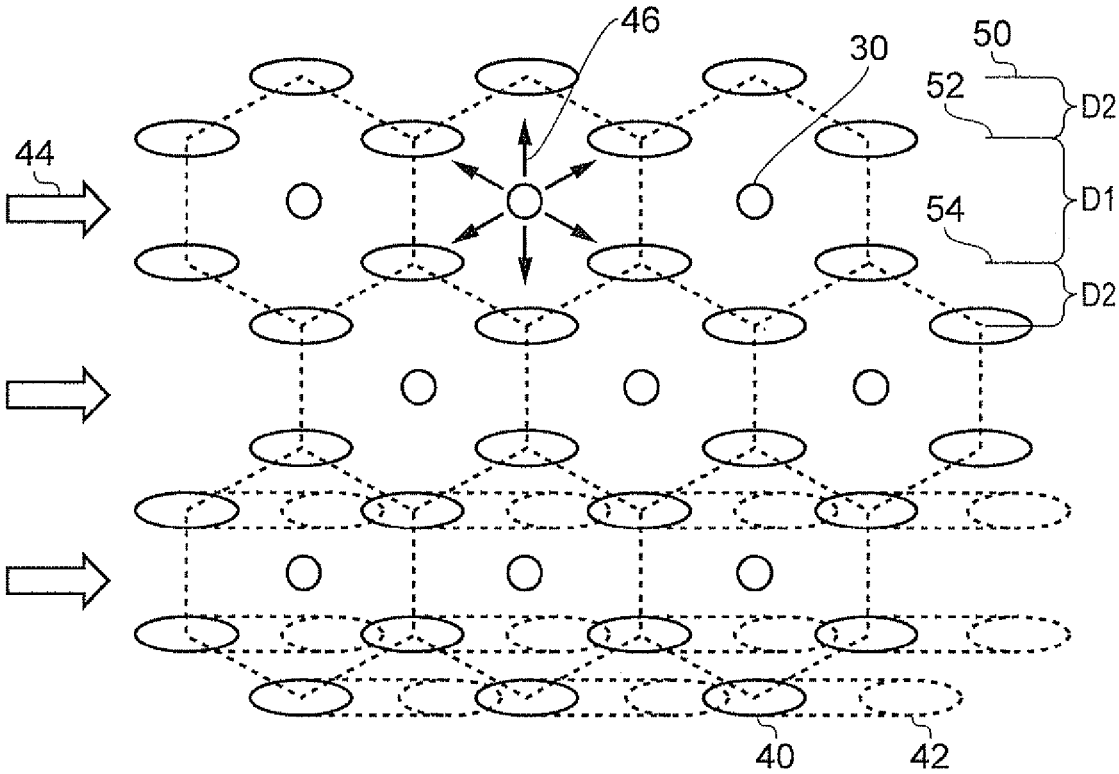

FIG. 3 shows a plan view of the cold surface 28 of the inner wall 22 with the flow direction of the hot combustion gas denoted by arrows 44. The effusion holes are arranged in hexagonal groups with each hole being part of three groups. The groups tessellate such that they cover the surface without spaces between the groups. An impingement location 30 is provided for each group to which an impingement jet is directed in use. The design impingement location is at the centre of the group but because the casing 20 and the inner wall 22 are at different temperatures caused by their relative positions to the hot combustion gasses and cooling air they expand at different rates that can cause the impingement location to move within its respective hexagonal group. The tolerance on the location is such that even at extreme temperatures the impingement location remains within its group. Relative movement between the casing and the inner wall and the casing can be of the order 1 mm as the combustor cycles up to operating temperature.

Arranging the effusion holes in tessellating hexagonal arrays has been found to be particularly advantageous because the group provides a relatively large spacing between the impingement location and the effusion holes and between neighbouring effusion holes that increases tolerance bands on machining inconsistencies such as hole size and location that reduces the risk of the structure failing at a quality check.

Hexagonal grids also assist in helping to provide the desired inner wall porosity that is typically between 1.5% and 2.5%. By porosity we mean the ratio of the device effective airflow feed area to wall surface area exposed to the flame and porosity can be adjusted by scaling the hexagon size downwards for higher porosity or adjusting the size of the effusion holes, though it is less desirable to adjust the size of the holes since this can affect the way the air film is formed on the hot surface and lead to a poorly formed protective film.

To achieve a porosity of around 2.5% a grid size of the order 5 mm, measured along the longest axis of symmetry of one of the hexagons, is required with each effusion hole being of the order of 1 mm in diameter. The ligament distance, or distance between the edge of one effusion hole and the edge of an adjacent cooling hole in the group, is therefore also of the order 1 mm.

The impingement air impinging at the impingement location 30 radiates uniformly and evenly across the cold surface 28 of the inner wall as denoted by arrows 46. Because the effusion hole inlets 40 are substantially equispaced from the impingement location each hole receives substantially the same amount of air.

As each effusion hole is supplied with air from three impingement locations the arrangement maintains a uniform flow volume through each of the holes despite differences in thermal expansion between the casing and the inner wall. Movement of one impingement location away from a selected effusion hole results in the movement of another impingement location towards the effusion hole. The volume of air flowing through each effusion hole is a function of the distance of the hole to the nearest impingement locations.

FIG. 3 shows an embodiment where the effusion holes are straight and angled with respect to the hot surface 34 with the exit holes being denoted by dashed lines 42. As each effusion hole is angled the outlets (and inlets) are oval in form with the longer axis of the oval lying in the direction of hot gas flow through the combustor. In this embodiment, for a regular hexagon, the groups are arranged with the general hot gas flow direction through the combustor being aligned with an axis of symmetry through the hexagon that bisects the perimeter of the hexagon between two effusion hole outlets rather than being aligned with an axis of symmetry through the hexagon that bisects the perimeter at one of the effusion holes.

As it is desirable for the effusion holes to be angled to release the cooling air with downstream momentum to facilitate formation of an effusion film the arrangement of FIG. 3 avoids extending an effusion hole under the impingement location 30. Were the groups rotated 30° to align the downstream flow with an axis symmetry through the hexagon that bisects the perimeter at one of the effusion holes the effusion hole would directly underlie the impingement location.

The efficiency of the impingement cooling is decreased where the impingement location overlies an effusion hole. The air of the impingement jet strikes the cold surface of the inner wall, which is at a higher temperature than the impingement jet, and sets a temperature gradient from cold to hot within the inner wall 22 that radiates from the impingement location. The air flowing through the effusion hole is of a similar temperature to the impingement jet and will distort the temperature gradient if it underlies the impingement location thus reducing the efficiency of the impingement cooling. Reduced cooling efficiency requires more air to achieve the same level of cooling and this air has to be taken from air that otherwise would be used to propel the engine or control emissions. Overall efficiency of the engine may be reduced accordingly.

One of the issues with the arrangement of FIG. 3 is that it provides different transverse spacing between adjacent rows of effusion outlets. Transverse means across surface of the wall perpendicular to the flow direction of the hot gas through the combustor. A line 50 drawn through the centre of one row of effusion outlets 42 is separated from a second line 52 drawn through the centre of a second row of effusion outlets by a distance D2. For a regular hexagon group of effusion outlets, a third line 54 drawn through the centre of a third row of effusion outlets is separated from the second line 52 by a distance D1. D1 is greater than D2 since for a regular hexagon, where the sides of the group have same length R, D1=R but D2=½R which gives an overall width of the group as 2R. The uneven transverse distribution of effusion holes can result in poor film coverage particularly at the centerline between outlet row 52 and outlet row 54 leading to an early failure of the inner wall of the combustor.

Figure 4:
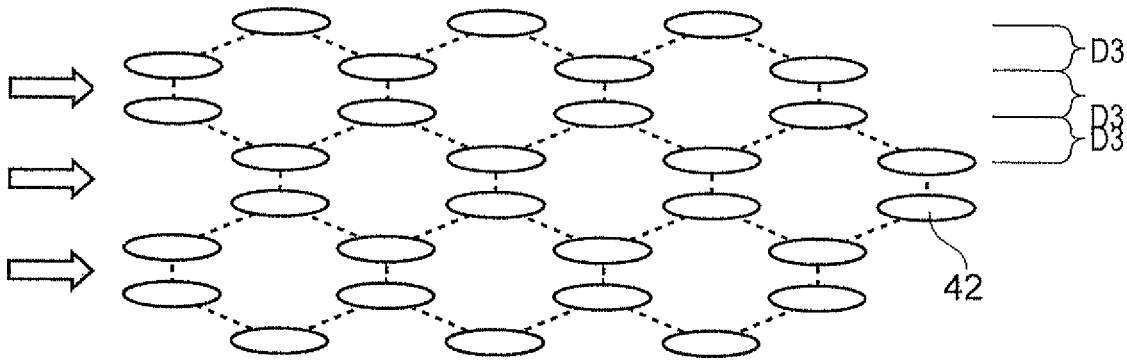
FIG. 4 shows an alternative cooling arrangement for a hot surface
Figure 5:
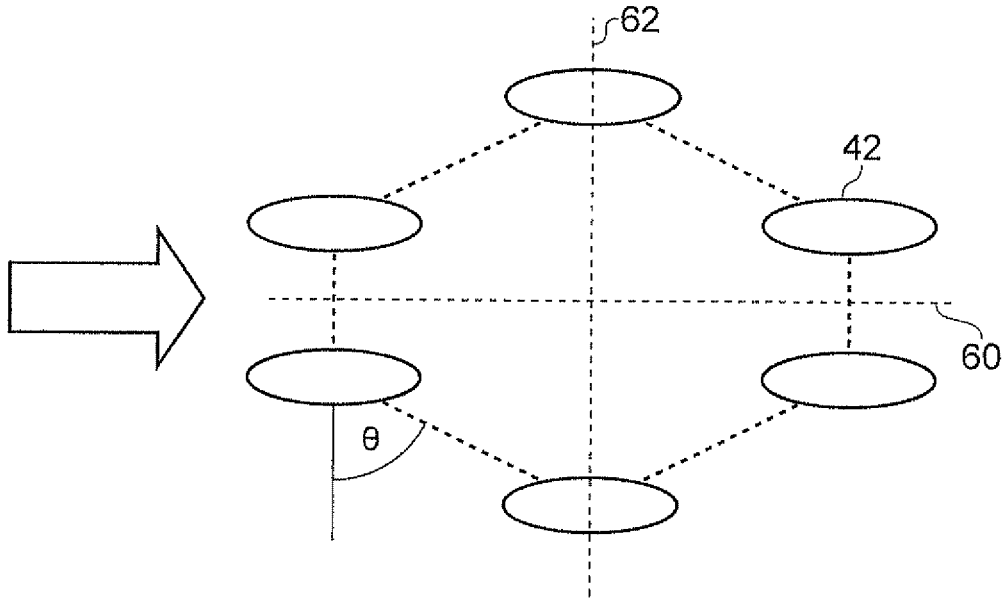
FIG. 5 is a larger drawing of one of the groups of FIG. 4

An arrangement, as shown in FIG. 4, to address this problem replaces the tessellated grid of regular hexagons with a tessellated grid of irregular hexagons. The outlets 42 of the effusion holes 32 are arranged such that straight lines drawn between the centre of the outlets to define the periphery of the groups define irregular hexagons which tessellate over the hot surface of the wall. The irregular hexagons have two axes of symmetry 60, 62 and two short sides of equal length and four long sides of equal length.

The axes of symmetry 60, 62 bisect the hexagon either at the centre of the short sides or through the centre of outlets 42 that are separated from their adjacent outlets by the long sides of the hexagon. The hexagonal grids are aligned with the direction of flow of the hot gas through the combustor such that the axis of symmetry 62 that bisects the short sided of the irregular hexagon is substantially parallel to the flow of hot gas.

Although it is possible to achieve equal transverse spacing D3 by just adjusting the length of the short sides of the grid the preferred arrangement reduces the angle θ from 60° to around 52° whilst providing short sides of the hexagon of ⅔R (R now being the length of the longer sides). Beneficially, this arrangement keeps the overall width of the hexagon as 2 R with D3 being ⅔R.

If it is desired to keep the angle θ at 60° to achieve equal transverse spacing D3 the overall width of the hexagon reduces to 1½R with the length of the short sides being ½R.

Although for laser drilled holes, which are generally straight, the pattern and spacing of the effusion hole inlets are likely to mimic the pattern and spacing of the effusion hole outlets, additive manufacturing methods that build up components by depositing a powder or wire into a molten pool melted by a high energy beam are capable of making complex passages. In these cases it is possible to have effusion holes with outlets to the holes arranged in a first pattern that has a uniform transverse spacing yet provide the inlets arranged in a second pattern optimised for uniform distance from an impingement location where the wall is intended for use in a double wall arrangement or optimised for some other reason where the wall is intended for use in a single wall arrangement. For example, it is common to provide pedestals or pillars on the cold surface of the inner wall to increase the surface area and improve cooling efficiency. The pedestals can affect the way the air feeds into the effusion holes and the inlet pattern may therefore be adjusted to provide distance between pedestals on the cold surface and the inlets to minimise flow disruption by the pedestals.

As mentioned earlier it is desirable for cooling efficiency that the impingement locations do not overlie the effusion holes. The axes of symmetry for a regular hexagon either pass through opposing corners of the hexagon at the locations of the effusion hole outlets or through opposing edges midway between adjacent outlets. Where the axis of symmetry which passes through the effusion holes is aligned with the flow of hot gas through the combustor the impingement location is typically immediately downstream of the effusion inlet with the effusion hole extending beneath the impingement location. Accordingly, this alignment of the hexagonal grid with the hot combustion gas flow is not used despite the advantages it offers in providing a transverse row spacing that is implicitly regular.

Figure 6:
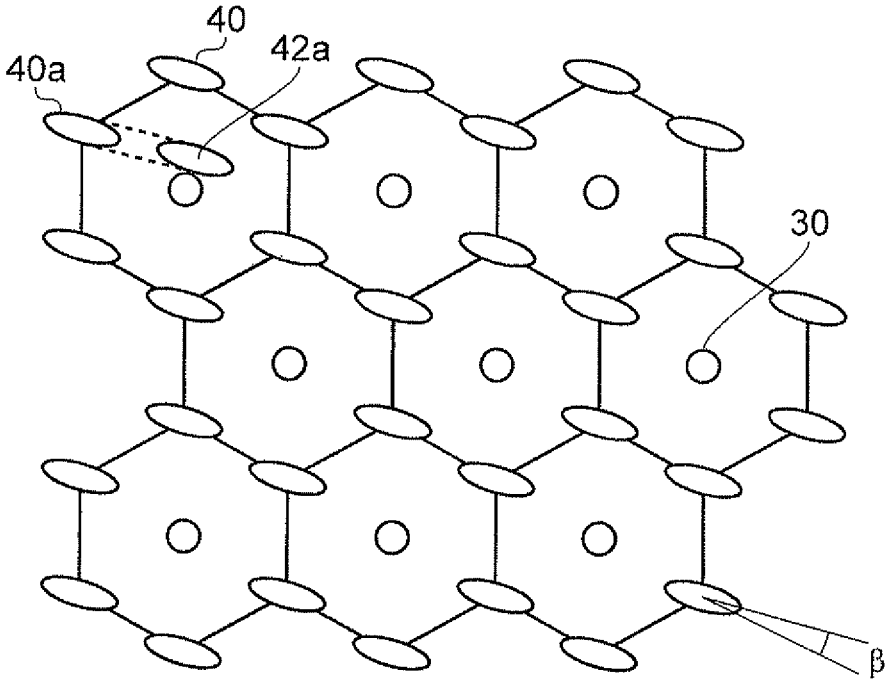
FIG. 6 shows an alternative arrangement of effusion hole inlets
Figure 7:
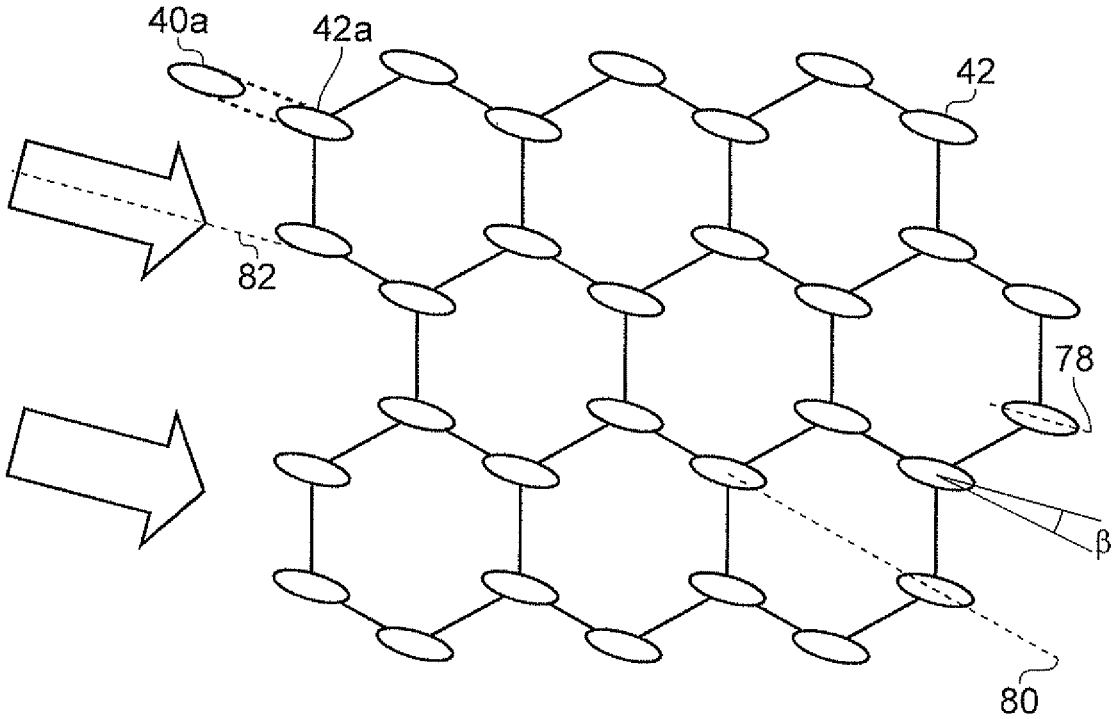
FIG. 7 shows an alternative arrangement of effusion hole outlets

In the arrangement shown in FIG. 6 and FIG. 7, the effusion holes are skewed with respect to an axis of symmetry of the hexagon drawn through two opposing outlets. FIG. 6 shows the cold surface configuration of the inner wall with the effusion hole inlets 40 being arranged in tessellated hexagonal groups around impingement locations 30. FIG. 7 depicts the hot surface arrangement of the arrangement of FIG. 6 with effusion hole opening 40*a* which leads to effusion hole outlet 42*a* being shown for both figures. The skew angle β is 11° or greater to shift the effusion holes away from the impingement location 30 on the cold surface of the wall.

The skew angle β is defined by an the angle between the longitudinal axis of the oval effusion hole outlet 78 and a line 80 along one of the axis of symmetry of the hexagonal group. The effusion hole axis 78 should be within 30° of the main flow direction 82 of the hot gas flowing through the combustor to effect formation of the effusion film. If the angle is too great then the main flow creates too much turbulence and poor film formation is achieved.

The axis of symmetry 80 of the hexagon can be rotated relative to the main flow direction 82. In the case of FIG. 7, where effusion hole axis and the main flow direction 82 are parallel the axis of symmetry of the hexagon is skewed by the angle β. Other angles are possible though it will be appreciated that varying the axis of the hexagon will adjust the effusion hole axis relative to the flow direction 82. By careful selection of the angles it possible to optimise cooling for a given combustor arrangement.

The invention has been described for an annular combustor for a gas turbine but it is equally applicable to other types of combustor e.g. can-annular or re-heat combustors etc. It is also applicable to furnaces where it is desirable to have an effusion film to protect the hot surfaces. The invention may also be used for protecting articles that are located in hot areas e.g. nozzle guide vanes etc. that are found at the transitions between the combustion chamber and the turbine in a gas turbine. The arrangement of effusion holes may also be used in single wall constructions rather than in the double wall construction described above.

For some combustors the cooling fluid, air in the example given above, may be replaced with other fluids e.g. another, perhaps inert, gas or liquid if the application for which the wall is being used in requires it.

Several embodiments have been described above. The embodiments may be combined or modified with features of the other embodiments where such combinations or modifications provide functionally acceptable alternatives.

The invention claimed is:

1. A cooling arrangement for a gas turbine, comprising:

a surface of a wall of the gas turbine, the wall having a plurality of effusion holes arranged in groups tessellated on the surface, the outlet of each effusion hole being located on a periphery of three groups; wherein each group has the shape of an irregular hexagon having two axes of reflective symmetry and four sides of equal length and two sides of a shorter length.

2. A cooling arrangement according to claim 1, wherein each effusion hole has an inlet that is connected to a respective outlet by a bore, with the inlet being laterally offset from its respective outlet in the plane of the surface.

3. A cooling arrangement according claim 2, wherein the bores are straight and the inlets have an oval shape, wherein the longer axis of the ovals are rotated in the plane of the surface away from an axis of symmetry.

4. A cooling arrangement according to claim 2, wherein the bores are directed to avoid the center of the group.

5. A cooling arrangement according claim 4, wherein the bores are straight and the inlets have an oval shape, wherein the longer axis of the ovals are rotated in the plane of the surface away from an axis of symmetry.

6. A cooling arrangement for a gas turbine, comprising:

a first wall of the gas turbine having a plurality of effusion holes disposed in the first wall, each effusion hole including an outlet onto a surface of the first wall for supplying an effusion flow to the surface and including an inlet, wherein the inlets of the effusion holes are arranged at the peripheries of groups tessellated on an opposing surface of the first wall, each inlet being located on the peripheries of three groups, the arrangement comprises a second wall of the gas turbine spaced apart from the opposing surface having impingement orifices each for directing a flow of air in use to a respective impingement location on the opposing surface, each group having a centrally positioned impingement location, and the peripheries of the groups tessellated on the opposing surface define regular or irregular hexagons.

7. A cooling arrangement according to claim 6, wherein the inlets of the effusion holes and their respective outlets are laterally offset in the plane of the surface.

8. A cooling arrangement according to claim 6, wherein the inlets of the effusion holes and their respective outlets are connected by a bore, the bores being directed to avoid the center of the group.

9. A cooling arrangement according claim 8, wherein the bores are straight and the inlets have an oval shape, wherein the longer axis of the ovals are rotated in the plane of the surface away from an axis of symmetry.

10. A method of cooling a surface of a wall of a gas turbine, the wall having a plurality of effusion holes each with an outlet onto the surface for supplying an effusion flow to the surface and an inlet, wherein the inlets of the effusion holes are arranged at the peripheries of groups tessellated on an opposing surface of the wall, each inlet being located on the peripheries of three groups, the wall being arranged with a second wall spaced apart from the opposing surface having impingement orifices each for directing a flow of air in use to a respective impingement location on the opposing surface, the method comprising the steps of:

directing a flow of air through each of the impingement orifices to the respective impingement location, and feeding the air through the effusion holes to form an effusion film on the surface of the wall having the outlets, wherein each respective impingement location is located centrally with respect to a corresponding one of the tessellated groups, and the peripheries of the groups define regular or irregular hexagons.

11. A method according to claim 10, wherein the air is fed through the effusion holes in use to provide a flow of air that emerges from the outlets in a direction that is substantially the same direction as combustion gasses flow through the combustor in use.

* * * * *